US005786129A

United States Patent [19]

Ellis

[11] Patent Number: 5,786,129

[45] Date of Patent: Jul. 28, 1998

[54] LASER-IMAGEABLE RECORDING CONSTRUCTIONS UTILIZING CONTROLLED, SELF-PROPAGATING EXOTHERMIC CHEMICAL REACTION MECHANISMS

[75] Inventor: Ernest Ellis, Harvard, Mass.

[73] Assignee: Presstek, Inc., Hudson, N.H.

[21] Appl. No.: 782,625

[22] Filed: Jan. 13, 1997

[51] Int. Cl.[6] ..... B41N 1/08

[52] U.S. Cl. ..... 430/302; 430/945; 430/270.12; 430/300; 101/457; 101/454

[58] Field of Search ..... 430/270.1, 300, 430/302, 270.12, 945; 401/454, 458, 457

[56] References Cited

U.S. PATENT DOCUMENTS

| | | | |
|---|---|---|---|
| 3,831,179 | 8/1974 | Brill et al. | 346/135.1 |
| 5,156,725 | 10/1992 | Doktycz et al. | 204/192.16 |
| 5,171,650 | 12/1992 | Ellis et al. | 430/201 |
| 5,326,619 | 7/1994 | Dower et al. | 430/201 |
| 5,354,633 | 10/1994 | Lewis et al. | 430/201 |
| 5,379,679 | 1/1995 | Nowak et al. | 101/454 |
| 5,459,018 | 10/1995 | Akahira | 430/270.12 |

FOREIGN PATENT DOCUMENTS

| | | |
|---|---|---|
| 1287494 | 1/1969 | Germany . |
| 60-194067 | 10/1985 | Japan . |
| 3-291379 | 12/1991 | Japan . |
| 5-132754 | 5/1993 | Japan . |
| 8-153882 | 6/1996 | Japan . |
| 8-208358 | 8/1996 | Japan . |

OTHER PUBLICATIONS

Seetharama C. Deevi, *Materials Science and Engineering*, A149:241–251 (1992).

Vladimir Hlavacek, *Ceramic Bulletin*, 70:240–243 (1991).

Z. G. Liu, et al., *Appl. Phys. Lett.*, 65:2666–2668 (1994).

Zuhair A. Munir, et al., *Materials Science Reports*, 3:277–365 (1989).

L.L. Ye et al., *NanoStructured Materials*, 5:25–31 (1995).

D.R. McKenzie, Appl. Opt., 17(12) pp. 1884–1888, Jun. 1978.

*Primary Examiner*—Martin Angebranndt

*Attorney, Agent, or Firm*—Cesari and McKenna, LLP

[57] ABSTRACT

Materials that undergo self-propagating exothermic solid-solid reaction upon ignition by a heating source (e.g., a laser) are used in the fabrication of recording constructions such as lithographic printing plates, photomasks and proofing sheets. A recording construction in accordance with the invention may include at least one ignition layer comprising at least two unreacted, solid chemical species which, upon exposure to heat, combine exothermically to form a final species that is physically disrupted; and a substrate thereunder that is substantially unconsumed by heat generated by the exothermic combination. To form a lithographic printing plate, the ignition layer (or its topmost component, or a surface layer thereover) and the substrate exhibit different affinities for ink and/or an abhesive fluid for ink.

28 Claims, 1 Drawing Sheet

LASER-IMAGEABLE RECORDING CONSTRUCTIONS UTILIZING CONTROLLED, SELF-PROPAGATING EXOTHERMIC CHEMICAL REACTION MECHANISMS

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

U.S. Pat. Nos. 5,339,737 and 5,379,698, the entire disclosures of which are hereby incorporated by reference, disclose a variety of lithographic plate configurations for use with imaging apparatus that operate by laser discharge (see, e.g., U.S. Pat. No. 5,385,092 and U.S. application Ser. No. 08/376,766). These include "wet" plates that utilize fountain solution during printing, and "dry" plates to which ink is applied directly.

In particular, the '698 patent discloses laser-imageable plates that utilize thin-metal ablation layers which, when exposed to an imaging pulse, are vaporized and/or melted even at relatively low power levels. The remaining unimaged layers are solid and durable, typically of polymeric or thicker metal composition, enabling the plates to withstand the rigors of commercial printing and exhibit adequate useful lifespans.

In one general embodiment, the plate construction includes a first, topmost layer chosen for its affinity for (or repulsion of) ink or an ink-abhesive fluid. Underlying the first layer is a thin metal layer, which ablates in response to imaging (e.g., infrared, or "IR") radiation. A strong, durable substrate underlies the metal layer, and is characterized by an affinity for (or repulsion of) ink or an ink-abhesive fluid opposite to that of the first layer. Ablation of the absorbing second layer by an imaging pulse weakens the topmost layer as well. By disrupting its anchorage to an underlying layer, the topmost layer is rendered easily removable in a post-imaging cleaning step. This, once again, creates an image spot having an affinity for ink or an ink-abhesive fluid differing from that of the unexposed first layer.

A considerable advantage to these types of plates is avoidance of environmental contamination, since the products of ablation are confined within a sandwich structure; laser pulses destroy neither the topmost layer nor the substrate, so debris from the ablated imaging layer is retained therebetween. This is in contrast to various prior-art approaches, where the surface layer is fully burned off by laser etching; see, e.g., U.S. Pat. Nos. 4,054,094 and 4,214,249. In addition to avoiding airborne byproducts, plates based on sandwiched ablation layers can also be imaged at low power, since the ablation layer does not serve as a printing surface and therefore need not be especially durable; a durable layer is generally thick and/or refractory, ablating only in response to significant energy input. The price of these advantages, however, is the above-noted post-imaging cleaning step.

In addition, the polymeric topmost coatings ordinarily required for the sandwiched-ablation-layer approach may exhibit less durability than traditional printing plates. For example, conventional, photoexposure-type wet plates may utilize a heavy aluminum surface capable of surviving hundreds of thousands of impressions. Sandwiched-ablation-layer plates, by contrast, utilize polymeric topcoats that pass laser radiation through to the ablation layer. Hydrophilic polymers, such as polyvinyl alcohols, do not exhibit the durability of metals.

Indeed, the very concept of ablation, whether or not the laser-responsive layer is sandwiched or exposed, poses challenges in terms of plate fabrication and system performance demands. Commercially feasible printing or plate-making apparatus generally utilize low-power lasers; consequently, the ablation layer must undergo catastrophic degradation as a result of limited energy input. Such layers must, therefore, be very thin (on the order of angstroms) or highly combustible (e.g., self-oxidizing). In the former case, it may be difficult to consistently obtain uniform, well-adhered ablation layers. Moreover, when the sandwiched ablation layer is metal, a careful balance must be struck between reflection, absorption and transmission of imaging radiation. Metals exhibit an inherent tendency to reflect radiation; at the miniscule deposition thicknesses required for low-power imaging, however, a metal layer will absorb some radiation (which provides the ablation mechanism) and also pass some through. Increasing the thickness of such a layer augments laser power requirements not only through the addition of material, but also due to increased reflection of imaging radiation. The overall result is a maximum thickness limit, which restricts the ability to increase plate durability through thicker metal imaging layers.

Furthermore, thin imaging layers based on metal/non-metal combinations (e.g., metal oxides) can exhibit rigidity when deposited on a flexible polymeric substrate. Rigidity, too, increases with layer thickness, and excessively thick metal/non-metal layers will be vulnerable to fracture; for example, dimensional stress leading to fracture can occur as a result of heating and cooling, as when a thermoset coating is applied over such a layer and cured. A printing plate with an imaging layer damaged in this way will exhibit poor durability and possibly a loss of image quality.

Self-oxidizing layers, such as those based on nitrocellulose (see, e.g., Canadian Patent No. 1,050,805), tend to exhibit limited or variable shelf-life, and may also be vulnerable to pH changes.

DESCRIPTION OF THE INVENTION

Brief Summary of the Invention

The present invention utilizes, as imaging layers, certain solid materials that undergo self-propagating exothermic solid-solid reaction upon ignition by a heating source (e.g., a laser). The self-propagating nature of the reaction offers a number of advantages. First, only the surface of the material need be heated to the ignition temperature to effect complete consumption of an entire plug of material beneath (and generally larger in area than) the heated surface. Second, and as a result, the thickness of the ablation layer need not be limited (or otherwise adjusted) to the accommodate the imaging device; instead, thickness can be tailored to optimize performance characteristics (such as durability), to simplify manufacturing, or to accommodate mounting or handling concerns.

Accordingly, in a first aspect, the invention comprises a recording construction directly imageable by heating (e.g., by application of laser radiation) and having at least one ignition layer comprising at least two unreacted, solid chemical species which, upon exposure to heat (e.g., through absorption of laser radiation), combine exothermically to form a final species which is physically disrupted—that is, removed (e.g., through volatilization) or rendered vulnerable to removal in the course of press roll-up or through a separate cleaning step; and a substrate thereunder that is substantially unconsumed (although possibly altered in a manner improving ink adsorption) by heat generated by the exothermic combination. The recording construction can serve as a printing plate (e.g., lithographic or flexographic), a photomask, a proofing sheet or other graphic-arts construction depending on choice of materials and the addition of further layers.

Because the combustion reaction is self-propagating, the applied heat necessary to induce disruption is largely independent of the overall thickness of the ignition layer. The thickness does, however, strongly influence the areawise amount of material disrupted by an imaging pulse. The combustion reaction spreads outwardly as it progresses depthwise through the thickness of the ignition layer; accordingly, as the ignition layer grows in thickness, the overall area disrupted by an imaging pulse of constant area expands. This relationship between disrupted area and thickness may be used to control the size of image spots produced, for example, by a laser having a given beam diameter. Because the amount of energy needed to initiate reaction remains substantially constant regardless of the affected area, the ability to reduce beam diameter translates into smaller laser power requirements and, generally, increased throughput. The optimal layer thickness for a given application is straightforwardly determined by those of ordinary skill in the art without undue experimentation.

In a photomask embodiment, the substrate is transparent, while the ignition layer (or layers) is opaque (or has an opaque overcoat), to actinic radiation. Imagewise ablation of the ignition layer reveals the transparent layer in a pattern corresponding to the image (or its negative), and the photomask can be used, for example, to prepare a printing plate or proofing material by conventional photoexposure.

By choosing a substrate and a visible ignition layer (or overlying sacrificial layer) that contrast in color, it is possible to create proofing sheets. In the simplest approach, the construction is analogous to that of the just-described photomask; the ignition layer is a single layer or a series of adjacent layers overlying a substrate that is transparent or colored differently from the ignition layer (or its topmost component, or a sacrificial layer thereover).

In a first lithographic plate embodiment, the ignition layer (or its topmost component) and the substrate exhibit different affinities for ink and/or an abhesive fluid for ink. In particular, the topmost ignition layer may be hydrophilic (in the printing sense of exhibiting affinity for fountain solution) and the substrate oleophilic; for example, the topmost layer may be titanium with a layer of carbon (e.g., graphite) disposed thereunder, ignition of the titanium producing an exothermic reaction with the underlying carbon to form physically disrupted TiC.

In a second lithographic plate embodiment, a separate surface layer is disposed above the ignition layer (or layers). In this embodiment, it is the surface layer that exhibits an affinity different from that of the substrate for ink and/or an abhesive fluid for ink. For example, the surface layer may be hydrophilic and the substrate oleophilic, or the surface layer may instead be oleophobic and the substrate oleophilic. In this case, the ignition layer may comprise, for example, separate layers of titanium and carbon, or a single layer containing an unreacted mixture of titanium and carbon.

Any of the foregoing constructions may comprise a tying layer for anchoring the bottommost ignition layer to the substrate, the tying layer being physically disrupted by the exothermic combination.

While titanium and carbon are useful reaction components in their exothermicity, availability and ease of deposition in varying thicknesses, other sets of reactants can alternatively be employed (either alone as a single set or in combination with other sets), in separate layers or as mixtures in a single layer. Such alternatives include aluminum and palladium, molybdenum and silicon, molybdenum and at least one chalcogenide, titanium and nickel, hafnium and carbon, silicon and carbon, titanium and silicon, tantalum and carbon, niobium and carbon, barium oxide and silicon oxide, and barium oxide and titanium oxide.

BRIEF DESCRIPTION OF THE DRAWINGS

The foregoing discussion will be understood more readily from the following detailed description of the invention, when taken in conjunction with the accompanying drawings, in which.

The drawings and components shown therein are not necessarily to scale.

DETAILED DESCRIPTION OF THE PREFERRED EMBODIMENTS

Figure 1:
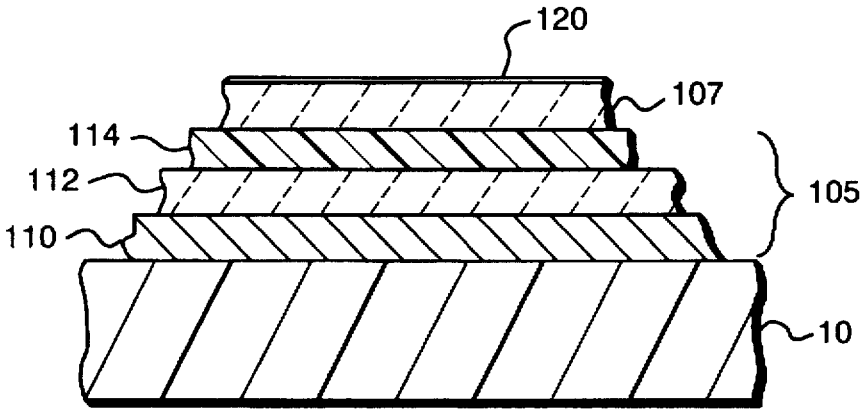
FIG. 1 is an enlarged sectional view of a general recording construction having at least a substrate and, disposed thereon, a series of layers that undergo exothermic, self-propagating combustion, and a metallic inorganic surface layer.

With reference to FIG. 1, a first embodiment of the present invention includes a substrate 100, a layer or series of layers 105 that undergo self-propagating exothermic solid-solid reaction upon ignition of one of the layers, and, optionally, a surface layer 107 whose identity, thickness and function depends on the application. In the illustrated embodiment, which may function as a lithographic printing plate, layers 105 include a 100 Å layer 110 of titanium, a 100 Å layer 112 of graphite, and a second 100 Å layer 114 of titanium. Layer 107 is a refractory layer that exhibits hydrophilicity, and may be a 300 Å layer of titanium nitride.

Substrate 100 is preferably strong, stable and flexible, and may be a polymer film, or a paper or metal sheet. Polyester films (in a preferred embodiment, the MYLAR film sold by E.I. duPont de Nemours Co., Wilmington, Del, or, alternatively, the MELINEX film sold by ICI Films, Wilmington, DE) furnish useful examples. A preferred polyester-film thickness is 0.007 inch, but thinner and thicker versions can be used effectively. More specifically, the optimal thickness of a polymer layer is determined primarily by the environment of use; for example, if the material is to be stored in a bulk roll within the interior of a plate cylinder and incrementally advanced around the exterior of the cylinder by a winding mechanism, flexibility will be more important than dimensional stability; thicknesses on the order of 0.007 inch are suitable for such applications.

Paper substrates are typically "saturated" with polymerics to impart water resistance, dimensional stability and strength. Aluminum is a preferred metal substrate. Ideally, the aluminum is polished so as to reflect any imaging radiation penetrating any overlying optical interference layers, and the construction includes apporpriate thermal insulation. One can also employ, as an alternative to a metal reflective substrate 100, a layer containing a pigment that reflects imaging (e.g., IR) radiation. A material suitable for use as an IR-reflective substrate is the white 329 film supplied by ICI Films, Wilmington, Del., which utilizes IR-reflective barium sulfate as the white pigment. A preferred thickness is 0.007 inch, or 0.002 inch if the construction is laminated onto a metal support.

Layer 107 is a hard, durable, hydrophilic layer disposed above a layers 105, and preferably above a metal layer 114, since the latter tends to improve overall adhesion. A finishing treatment 120, as described below, may be applied to layer 107.

Layer 107 is a metallic inorganic layer comprising a compound of at least one metal with at least one non-metal, or a mixture of such compounds. Layer 107 ablatively absorbs imaging radiation, or passes sufficient radiation to overheat underlying layer 114 and thereby induce self-propagating combustion of layers 105, which will also ablate the region of layer 107 upon which radiation was incident (if the radiation was not itself sufficient to do so). Layer 107 may be applied at a thickness of 100–2000 Å. Accordingly, the choice of material for layer 107 is critical, since it must serve as a printing surface in demanding commercial printing environments, yet ablate in response to imaging radiation.

The metal component of layer 107 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 107 may be one or more of the p-block elements boron, carbon, nitrogen, oxygen and silicon. A metal/non-metal compound in accordance herewith may or may not have a definite stoichiometry, and may in some cases (e.g., Al-Si compounds) be an alloy. Preferred metal/non-metal combinations include TiN, TiON, $TiO_x$ (where $0.9<x<2.0$), TiAlN, TiAlCN, TiC and TiCN.

The material forming layer 120 preferably comprises a polyalkyl ether compound with a molecular weight that depends on the mode of application and the conditions of plate fabrication. For example, when applied as a liquid, the polyalkyl ether compound may have a relatively substantial average molecular weight (i.e., at least 600) if the plate undergoes heating during fabrication or experiences heat during storage or shipping; otherwise, lower molecular weights are acceptable. A coating liquid should also exhibit sufficient viscosity to facilitate even coating at application weights appropriate to the material to be coated.

A preferred formulation for aqueous coating comprises 80 wt % polyethylene glycol (PEG) with an average molecular weight of about 8000 combined with 20 wt % hydroxypropyl cellulose to serve as a thickener. A formulation according to this specification was prepared by combining 4.4 parts by weight ("pbw") of Pluracol 8000 (supplied by BASF, Mt. Olive, N.J.) with 1.1 pbw of Klucel G or 99-G "FF" grade hydroxypropyl cellulose (supplied by the Aqualon division of Hercules Inc., Wilmington, Del). The ingredients were blended together as dry powders and the mixture slowly added to 28 pbw of water at 50°–55° C. with rapid agitation, allowing the powders to be wetted between additions. The mixture were stirred for 20–30 min. while maintaining the temperature between 50°–55° C., thereby wetting the Klucel particles and dissolving the Pluracol. At this point 66.5 pbw of cold water (ca. 5°–10° C.) was added all at once, bringing the mixture temperature close to or below room temperature. Stirring was continued for 1–2 hours until solution was complete. The fluid viscosity was measured at about 100 cp.

Other materials and formulations can be used to advantage. For example, the polyalkyl ether can be replaced with a polyhydroxyl compound, a polycarboxylic acid, a polysulfonamide or a polysulfonic acid or mixtures thereof. Gum arabic or the gumming agents found in commercial plate finishers and fountain solutions can also be used to provide the protective layer. The TRUE BLUE plate cleaning material and the VARN TOTAL fountain solution supplied by Varn Products Company, Oakland, N.J. are also suitable for this purpose, as are the FPC product from the Printing Products Division of Hoescht Celanese, Somerville, N.J., the G-7A-"V"-COMB fountain solution supplied by Rosos Chemical Co., Lake Bluff, Ill., the VANISH plate cleaner and scratch remover marketed by Allied Photo Offset Supply Corp., Hollywood, Fla., and the the POLY-PLATE plate-cleaning solution also sold by Allied. Still another useful finishing material is polyvinyl alcohol, applied as a very thin layer.

The protective layer 120 is preferably applied at a minimal thickness consistent with its roles, i.e., providing protection against handling and environmental damage, extending plate shelf life by shielding the plate from airborne contaminants, and entraining debris produced by imaging. The thinner layer 120 can be made, the more quickly it will wash off during press make-ready, the shorter will be the roll-up time, and the less the layer will affect the imaging sensitivity of the plate. Keeping layer 120 thin also minimizes contamination of fountain solution, or upset of the balance between fountain solution and ink.

Although illustrated as a series of discrete layers 105, the combustion reactants can instead be mixed, in an unreacted solid (generally powdered) form, and applied as a single layer. In addition to titanium and carbon, the materials of layers 105 (or, again, mixed within a single layer 105) may include such alternatives as aluminum and palladium, molybdenum and silicon, molybdenum and at least one chalcogenide, titanium and nickel, hafnium and carbon, silicon and carbon, titanium and silicon, tantalum and carbon, niobium and carbon, barium oxide and silicon oxide, and barium oxide and titanium oxide. Layers 105 can also include mixtures of these sets of materials in single or discrete layers.

Depending on the materials chosen for the topmost layer 105 (i.e., layer 114 in FIG. 1) it may be possible to eliminate layer 107. For example, in the illustrated embodiment, titanium layer 114, when exposed to air, develops a native oxide surface that accepts fountain solution and can therefore serve as a printing surface. Finishing layer 120 can be applied directly to a titanium/titanium oxide layer serving as is a printing surface.

The constituents of layers 105 may be applied by vacuum evaporation or sputtering (e.g., with argon); it is preferred to vacuum sputter onto a plasma-treated polyester substrate 100. A titanium nitride layer 107 may be applied, for example, by reactively sputtering titanium in an atmosphere of argon and nitrogen.

In operation, the construction may be imaged in accordance, for example, with the '092 patent; one or more diode lasers emitting in the near-IR region are scanned over the surface of the plate and actuated in an imagewise pattern, thereby causing combustion and ablation of the layers overlying substrate 100 in spots corresponding to image portions of the construction. When the construction is used to print on a press, unremoved portions of layer 107 accept fountain solution, while exposed portions of substrate 100 accept ink. Because of the intense nature of the combustion reaction and the very small overall thickness of layers 105, little debris is generated as a consequence of imaging. The use of a finishing layer 120 obviates the need for any separate cleaning step, since whatever debris remains will be entrained in layer 120, which is itself removed during press roll-up.

Alternatively, the construction can be formed as a photomask. In this case, layer 107 may be eliminated, and the necessary opacity to actinic radiation provided by layers 105. Because these layers all participate in a self-propagating combustion reaction, it is not necessary to restrict the overall thickness to conform to imaging power limitations, so the fabricator is free to use as many layers 105 as are appropriate to the application; of course, a layer 107 of particularly high opacity can be employed in order to limit the number of layers 105 if this is desired. Substrate 100 is transparent to actinic radiation, so selective, imagewise removal of layers 105 (by heating, e.g., with low-power, near-IR imaging radiation) produces a photomask that can be used in the exposure of, for example, a traditional, photochemically developed printing plate or proofing material.

To create a proofing sheet, layer 107 (or the top layer 105) contrasts in color with substrate 100; alternatively, substrate 100 can be transparent.

Figure 2:
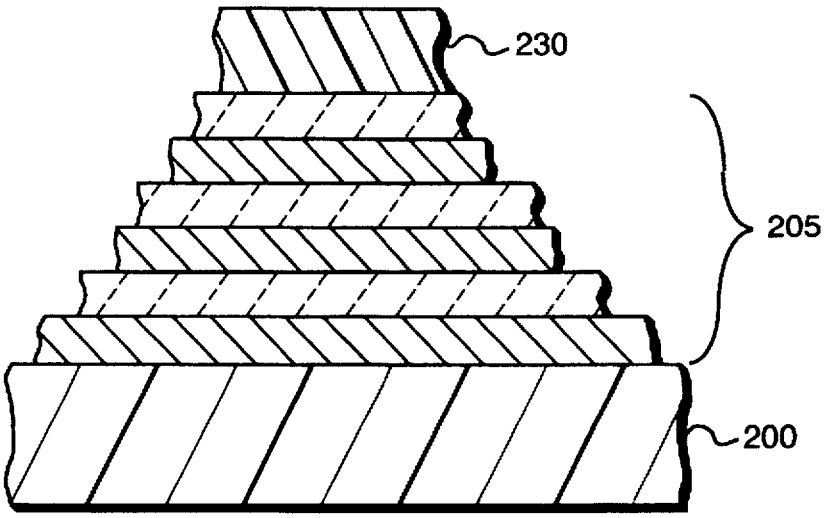
FIG. 2 is an enlarged sectional view of a lithographic plate embodying the invention and having a substrate, a series of layers that undergo exothermic, self-propagating combustion, and a polymeric surface layer.

FIG. 2 illustrates a second embodiment of the invention directed toward lithographic printing. Once again the construction includes a substrate 200 and a stack of ignition layers 205. The top layer 230, however, is a polymeric coating that exhibits an affinity for fountain solution and/or ink different from that of substrate 200. In one version of this construction, surface layer 230 is a silicone polymer or fluoropolymer that repels ink, while substrate 100 is an oleophilic polyester or aluminum material; the result is a dry plate. In a second, wet-plate version, surface layer 230 is a hydrophilic material such as a polyvinyl alcohol (e.g., the Airvol 125 material supplied by Air Products, Allentown, Pa.), while substrate 100 is both oleophilic and hydrophobic (again, polyester is suitable).

For dry-plate constructions that utilize a silicone layer 230, it is preferred to use a titanium layer 205 immediately benath layer 230 (i.e., as the layer onto which layer 230 is coated). Particularly where the silicone is cross-linked by addition cure, an underlying titanium layer offers substantial advantages over other metals. Coating an addition-cured silicone over a titanium layer results in enhancement of catalytic action during cure, promoting substantially complete cross-linking; and may also promote further bonding reactions even after cross-linking is complete. These phenomena strengthen the silicone and its bond to the titanium layer, thereby enhancing plate life (since more fully cured silicones exhibit superior durability), and also provide resistance against the migration of ink-borne solvents through the silicone layer (where they can degrade underlying layers). Catalytic enhancement is especially useful where the desire for high-speed coating (or the need to run at reduced temperatures to avoid thermal damage to the ink-accepting support) make full cure on the coating apparatus impracticable; the presence of titanium will promote continued cross-linking despite temperature reduction.

Useful materials for layer 230 and techniques of coating are disclosed in the '737 and '698 patents as well as in U.S. Pat. Nos. 5,188,032 and 5,353,705, the entire disclosures of which are hereby incorporated by reference. Basically, suitable silicone materials are applied using a wire-wound rod, then dried and heat-cured to produce a uniform coating deposited at, for example, 2 g/m$^2$. In the case of polyvinyl alcohols, suitable materials are typically produced by hydrolysis of polyvinyl acetate polymers. The degree of hydrolysis affects a number of physical properties, including water resistance and durability. Thus, to assure adequate plate durability, the polyvinyl alcohols used in the present invention reflect a high degree of hydrolysis as well as high molecular weight. Effective hydrophilic coatings are sufficiently crosslinked to prevent redissolution as a result of exposure to fountain solution, but also contain fillers to produce surface textures that promote wetting. Selection of an optimal mix of characteristics for a particular application is well within the skill of practitioners in the art. Useful polyvinyl-alcohol surface coatings may be applied, for example, using a wire-wound rod, followed by drying for 1 min at 300 ° F. in a convection oven to application weight of 1 g/m$^2$.

Laser output generally passes through layer 230 and heats the topmost layer 205, initiating ignition and self-propagating combustion. Ablation of layers 205 weakens or removes layer 230 as well. If not entirely removed, the weakened surface coating 230 (and any debris remaining from destruction of the absorbing second layer) is removed in a post-imaging cleaning step. In particular, such cleaning can be accomplished using a contact cleaning device such as a rotating brush (or other suitable means as described, for example, in U.S. Pat. Nos. 5,148,746 and 5,568,768), without fluid or with a non-solvent for the topmost layer, or with a cleaning mixture containing a balance of solvent and non-solvent components.

Any of the foregoing constructions used as lithographic printing plates can, if desired, by laminated to a metal support as set forth, for example, in the '032 patent and U.S. Pat. No. 5,570,636, the entire disclosure of which is hereby incorporated by reference.

Lithographic Printing Plates

EXAMPLE 1

A purple, laser-imageable lithographic printing plate in accordance with FIG. 1 was prepared in a vacuum chamber by reactively plasma etching a polyester sheet in an argon/nitrogen atmosphere, followed by successive sputter depositions of a 100 Å layer of titanium, a 100 Å layer of graphite, a 100 Å layer of titanium, and a 300 layer of titanium nitride. The plate was imaged using a Presstek PEARL platesetter (a computer-to-plate imagesetter utilizing diode lasers as discussed above) with an imaging laser flux of about 200 mJ/cm$^2$. Used as a wet plate on a printing press, the plate exhibited a useful life—that is, the number of impressions achieved before any noticeable print image degradation—of over 100,000 impressions.

EXAMPLE 2

A blue-colored, laser-imageable lithographic printing plate was prepared by repeating the procedure set forth in Example 1 with the exception of increasing the thickness of the titanium nitride layer to 600 Å. Imaged as set forth in Example 1, the plate exhibited a useful life in excess of 100,000 impressions.

EXAMPLE 3

A gray-green, laser-imageable lithographic printing plate was prepared in a vacuum chamber by reactively plasma etching a polyester sheet in an argon/nitrogen atmosphere, followed by successive sputter depositions of a 50 Å layer of titanium, a 50 Å layer of graphite, a 50 Å layer of titanium, a 50 Å layer of graphite, a 50 Å layer of titanium, a 50 Å layer of graphite, and finally a 300 Å layer of titanium nitride. Imaged as set forth in Example 1, the plate exhibited a useful life in excess of 100,000 impressions.

EXAMPLE 4

A dry laser-imageable lithographic printing plate in accordance with FIG. 2 is prepared in a vacuum chamber by reactively plasma etching a polyester sheet in an argon/nitrogen atmosphere, followed by successive sputter depositions of a 50 Å layer of titanium, a 50 Å layer of graphite, a 50 Å layer of titanium, a 50 Å layer of graphite, a 50 Å layer of titanium, a 50 Å layer of graphite. This structure is overcoated with the silicone formulation described in U.S. Pat. No. 5,487,338 (Examples 1–7); the silicone is applied by solvent to a dry coat weight of about 2 $g/m_2$ and then cured, after which the plate is imaged and used to print copy on a waterless press.

EXAMPLE 5

A wet laser-imageable lithographic printing plate in accordance with FIG. 2 is prepared in a vacuum chamber by reactively plasma etching a polyester sheet in an argon/nitrogen atmosphere, followed by successive sputter depositions of a 50 Å layer of titanium, a 50 Å layer of graphite, a 50 Å layer of titanium, a 50 Å layer of graphite, a 50 Å layer of titanium, a 50 Å layer of graphite. This structure is overcoated with the polyvinyl alcohol formulation described in U.S. Pat. No. 5,487,338 (Example 17); the polyvinyl alcohol is applied by solvent to a dry coat weight of about 1.2 $g/m^2$ and then cured, after which the plate is imaged and used to print copy on a wet press.

It will therefore be seen that the foregoing approach can be used to produce a variety of graphic-arts constructions suitable for use as lithographic printing plates, photomasks and proofing sheets. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A printing member directly imageable by laser discharge, the member comprising:

a. at least one ignition layer comprising at least two unreacted, solid chemical species, neither of which comprises a metal oxide and which, upon exposure to heat, combine exothermically to form a final species; and b. a substrate thereunder, wherein c. the at least one ignition layer is removed or rendered removable by the exothermic combination triggered by laser exposure, whereas the substrate is substantially unconsumed by the exothermic combination; and d. at least one ignition layer comprises a surface layer, the surface layer and the substrate exhibiting different affinities for at least one printing liquid selected from the group consisting of ink and an abhesive fluid for ink.

2. The construction of claim 1 wherein the surface layer is hydrophilic and the substrate is oleophilic.

3. The construction of claim 2 wherein the surface layer is titanium.

4. The construction of claim 3 wherein the at least one ignition layer comprises the titanium surface layer and, thereunder, a layer of carbon.

5. The construction of claim 2 further comprising a finishing layer over the hydrophilic layer.

6. The construction of claim 2 further comprising a finishing layer over the surface layer.

7. The construction of claim 1 further comprising a surface layer disposed above the at least one ignition layer, the surface layer and the substrate exhibiting different affinities for at least one printing liquid selected from the group consisting of ink and an abhesive fluid for ink.

8. The construction of claim 7 wherein the surface layer is hydrophilic and the substrate is oleophilic.

9. The construction of claim 8 wherein the surface layer is titanium nitride.

10. The construction of claim 8 wherein the surface layer is a polyvinyl alcohol chemical species.

11. The construction of claim 7 wherein the surface layer is oleophobic and the substrate is oleophilic.

12. The construction of claim 11 wherein the surface layer is silicone.

13. The construction of claim 1 wherein the at least one ignition layer comprises carbon and titanium.

14. The construction of claim 13 wherein the carbon and titanium are mixed in a single layer.

15. The construction of claim 13 wherein the carbon and titanium are in separate layers.

16. The construction of claim 13 wherein the aluminum and palladium are in separate layers.

17. The construction of claim 1 wherein the at least one ignition layer comprises aluminum and palladium.

18. The construction of claim 17 wherein the aluminum and palladium are mixed in a single layer.

19. The construction of claim 1 wherein the at least one ignition layer comprises at least one set of substances selected from the group consisting of (a) molybdenum and silicon, (b) molybdenum and at least one chalcogenide, (c) titanium and nickel, (d) hafnium and carbon, (e) silicon and carbon, (f) titanium and silicon, (g) tantalum and carbon, and (h) niobium and carbon.

20. The construction of claim 1 further comprising a tying layer for anchoring the at least one ignition layer to the substrate, the tying layer being removed or rendered removable by the exothermic combination.

21. A method of imaging a lithographic printing member, the method comprising the steps of:

a. providing a printing member including (i) at least one ignition layer comprising a surface layer and at least two unreacted, solid chemical species which, upon exposure to heat, combine exothermically to form a final species and (ii) a substrate thereunder, the at least one ignition layer being removed or rendered removable by the exothermic combination and the substrate remaining substantially unconsumed by the exothermic combination, the surface layer and the substrate exhibiting different affinities for at least one printing liquid selected from the group consisting of ink and an abhesive fluid for ink; and b. scanning at least one heat source over the printing member and selectively exposing, in a pattern representing an image, the printing member to the heat-source output during the course of the scan, thereby removing or facilitating removal of the at least one ignition layer to produce on the member an array of image features.

22. The method of claim 21 wherein the heat source is a laser.

23. The method of claim 22 the laser emits near-IR radiation.

24. The method of claim 21 wherein the surface layer is hydrophilic and the substrate is oleophilic.

25. The method of claim 24 wherein the surface layer is titanium nitride.

26. The method of claim 24 wherein the surface layer is a polyvinyl alcohol chemical species.

27. The method of claim 21 wherein the surface layer is oleophobic and the substrate is oleophilic.

28. The method of claim 27 wherein the surface layer is silicone.

* * * * *